US008757932B2

(12) United States Patent
Beck

(10) Patent No.: US 8,757,932 B2
(45) Date of Patent: Jun. 24, 2014

(54) APPARATUS AND METHOD FOR SECURING SUBSEA DEVICES TO A SEABED

(75) Inventor: Blaine E. Beck, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 447 days.

(21) Appl. No.: 12/820,248

(22) Filed: Jun. 22, 2010

(65) Prior Publication Data

US 2011/0274503 A1 Nov. 10, 2011

Related U.S. Application Data

(63) Continuation-in-part of application No. 12/775,723, filed on May 7, 2010, now abandoned.

(51) Int. Cl.
*E02D 5/74* (2006.01)

(52) U.S. Cl.
USPC ..... 405/226; 166/341

(58) Field of Classification Search
USPC ..... 405/203, 208, 224, 224.1, 226, 227; 166/338–341, 344–345, 348–349, 382
See application file for complete search history.

(56) References Cited

U.S. PATENT DOCUMENTS

| | | | | |
|---|---|---|---|---|
| 3,460,614 | A * | 8/1969 | Burgess | 166/335 |
| 3,877,520 | A | 4/1975 | Putnam | |
| 3,987,638 | A | 10/1976 | Burkhardt et al. | |
| 4,069,681 | A * | 1/1978 | Mott | 405/226 |
| 4,432,671 | A * | 2/1984 | Westra et al. | 405/226 |
| 5,224,962 | A | 7/1993 | Karel et al. | |
| 7,324,406 | B2 | 1/2008 | Berg | |
| 2003/0109989 | A1 | 6/2003 | Bagaini et al. | |

FOREIGN PATENT DOCUMENTS

WO 03099646 12/2003

OTHER PUBLICATIONS

U.S. Appl. No. 12/360,697, filed Jan. 27, 2009, Delfino et al.
Docherty, P., D. Hays, R. Shurtleff, and J. Paffenholz, 2005, Multi-Component Ocean Bottom Seismic Data Acquired with an Autonomous Node System: 67th Meeting, EAGE, Expanded Abstracts, B022.
Schneider, W. A., P. J. Farrell, and R. E. Brannian, 1964, Collection and analysis of Pacific Ocean bottom seismic data: Geophysics, 29 , No. 5, 745-771.
Berg, E., B. Svenning, and J. Martin, 1994, Sumic—a new strategic tool for exploration and reservoir mapping: 56th Meeting, EAGE, Expanded Abstracts , Session:G055.
Westerdahl, H., P. Sparrevik, C. Madshus, L. Amundsen, and J. Fjellanger, 2004, Development and testing of a prototype seabed coupled shear-wave vibrator: 74th Annual International Meeting, SEG, Expanded Abstracts , 929-932.
International Search Report and Written Opinion for PCT/US2011/033091 dated Sep. 29, 2011, 6 pages.

* cited by examiner

*Primary Examiner* — Sunil Singh
(74) *Attorney, Agent, or Firm* — Nicholas Gallo; John E. Vick

(57) ABSTRACT

An apparatus and method for securing subsea devices to a seabed are provided. The apparatus generally includes a mud can housing that defines a internal space that can be evacuated to drive the housing into the seabed and secured it thereto. At least one receiver is connected to the housing. Each receiver is configured to receive a subsea device so that each subsea device in each receiver is secured to the seabed in a vertical orientation when the mud can housing is secured to the seabed.

10 Claims, 10 Drawing Sheets

APPARATUS AND METHOD FOR SECURING SUBSEA DEVICES TO A SEABED

CROSS REFERENCE TO RELATED APPLICATIONS

This application is a continuation-in-part of U.S. patent application Ser. No. 12/775,723, filed May 7, 2010, which is hereby incorporated herein in its entirety by reference.

BACKGROUND OF THE INVENTION

1. Field of the Invention

This invention relates to an apparatus and method for securing subsea devices to a seabed, such as for securing pumps, separators, compressors, solids management equipment, or other equipment used in the handling or processing of fluids for producing fluids from a subsea hydrocarbon reservoir, e.g., to temporarily secure such a device to a seabed and subsequently remove it therefrom.

2. Description of Related Art

In the production of fluids from a subsea hydrocarbon reservoir, it may be advantageous to provide a variety of subsea devices to enable or aid in the production process. For example, subsea pumps can be used to deliver fluids produced from such a reservoir through a pipeline that extends to a topside processing or storage facility. Pumps can also be used for increasing the pressure of an injection fluid, i.e., a fluid injected into the reservoir to aid in the production of fluids from the reservoir. Separators can be used to promote phase separation, e.g. oil, gas, water, and solids, and direction of the products of separation to downstream equipment or to dampen flow surges.

Some subsea devices are conventionally used by installing the devices directly into a well. These devices, commonly termed "in-well" devices, are typically designed and constructed with a high aspect ratio, i.e., to be tall with a small footprint so that the devices will fit into a wellbore of a relatively small diameter. For example, some in-well devices are 4 to 10 inches or less in diameter and are 10-250 feet in height. A variety of different subsea devices that are tall and narrow in diameter have been developed for such intended installation and use in wellbores. Additional in-well devices are anticipated to be produced in the future. While these in-well devices can be effective when used in this manner, the difficulty and cost for installing and servicing such devices can be high. In addition, the number of devices that can be used in a particular well is typically limited.

Thus, a need exists for an improved apparatus and method for deploying and using such subsea devices. The apparatus and method should be compatible with subsea devices that have a high aspect ratio, including in-well devices that are designed for use in wellbores, and should be capable of installations in which each subsea device is disposed in its vertical orientation.

SUMMARY OF THE INVENTION

The embodiments of the present invention generally provide an apparatus and method for securing subsea devices to a seabed, e.g., for securing subsea devices that have a high aspect ratio. The subsea devices can be disposed in their vertical orientation, e.g., an orientation that the subsea device is typically disposed when used in a wellbore. It is appreciated that the subsea devices can include pumps and other devices, which may be designed and proven for use in wellbores. For example, the subsea devices can include one or more separator for pre- or post-processing of the fluids, and a plurality of subsea pumps, and the apparatus can be configured to receive a flow of fluid from a subsea reservoir, separate different phase components of the fluid, and deliver at least some of the components of the fluid therefrom at an increased pressure.

According to one embodiment of the present invention, the apparatus includes a mud can housing having a circumferential side and an upper side that define a space therein. The housing has an open bottom so that the housing is configured to be driven into the seabed and secured to the seabed by evacuating the space within the housing. At least one receiver is connected to the housing. Each receiver defines a vertically-oriented cavity configured to receive a subsea device in a vertical orientation so that each subsea device in each receiver is secured to the seabed in a vertical orientation when the mud can housing is secured to the seabed. In some cases, a plurality of receivers are connected to the housing, each receiver being configured to receive a respective subsea device, and some or all of the receivers can be located about a perimeter of the housing and connected to the circumferential side of the housing. One or more subsea devices can be disposed entirely within a respective one of the receivers, or each device can extend above the upper side of the housing, e.g., so that the device extends above the seabed and the housing when installed.

Each receiver can be configured to receive the respective subsea device through an opening defined in the top of the apparatus so that the subsea devices can be installed in the apparatus and removed from the apparatus while the housing is secured to the seabed. Each receiver can define an orientation feature that is configured to rotate a subsea device that is lowered into the receiver so that the device is rotated to a predetermined orientation when installed therein.

In some cases, each receiver defines at least one receiver connector configured to mate with a corresponding connector of a subsea device installed in the receiver, each receiver being connector configured to provide one or more electrical connections (for power and/or communication/instrumentation) and/or one or more fluid connection ports (for primary fluid entry and exit and/or secondary fluid, e.g. chemical treating, corrosion inhibition, anti-scale and hydrate inhibition fluids addition) entry to the devices. A manifold can be provided and configured to fluidly connect the subsea devices to a plurality of ports on the housing so that the devices can be connected in a plurality of configurations by selectively providing fluid links between the ports.

According to one method of the present invention, a mud can housing is disposed on the seabed, the mud can housing having a circumferential side and an upper side that define a space therein. The space within the housing is evacuated to thereby drive the housing into the seabed and secure the housing to the seabed. One or more subsea devices are disposed in one or more receivers connected to the housing so that each subsea device is secured to the seabed in a vertical orientation. For example, the method can include providing a mud can housing that defines a plurality of the receivers located about a perimeter of the housing and connected to the circumferential side of the housing. In one example, at least one separator and a plurality of subsea pumps are disposed in receivers of the apparatus so that the apparatus is configured to receive a flow of fluid from a subsea reservoir, separate different phase components of the fluid, and deliver at least some of the components of the fluid therefrom at an increased pressure.

Each subsea device can be lowered into the receiver so that the subsea device is rotated by an orientation feature of the receiver and rotated to a predetermined position, in orientation and/or elevation. One or more electrical and/or fluid connections can be formed between the subsea devices. In some cases, the devices can be connected via a manifold to a plurality of ports on the housing, and the devices can be connected in a desired configuration by selectively providing fluid links between the ports. Each subsea device can be removed from the receiver while the housing is secured to the seabed, e.g., for maintenance, repair, or replacement.

BRIEF DESCRIPTION OF THE DRAWINGS

Figure 1:
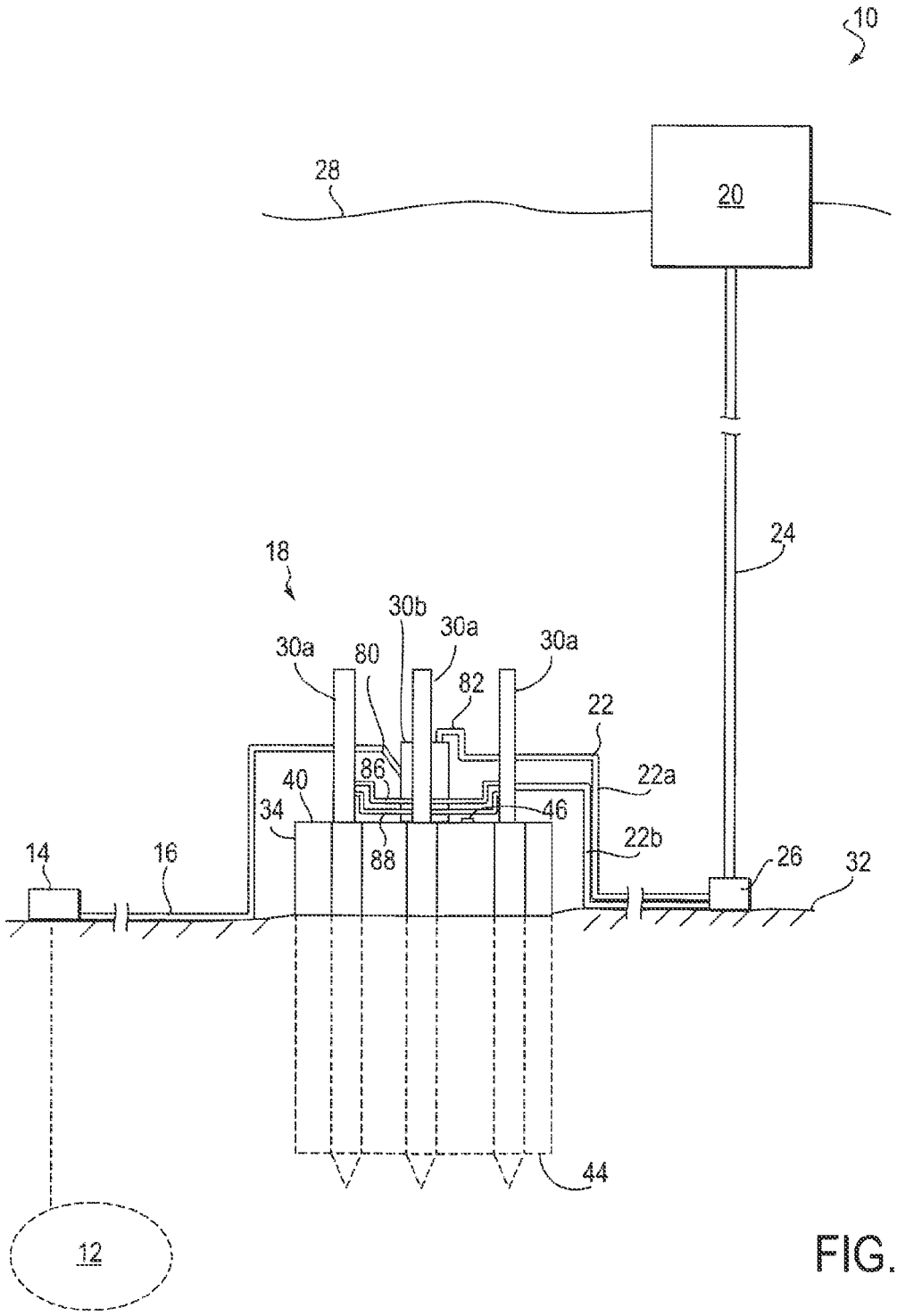
Figure 2:
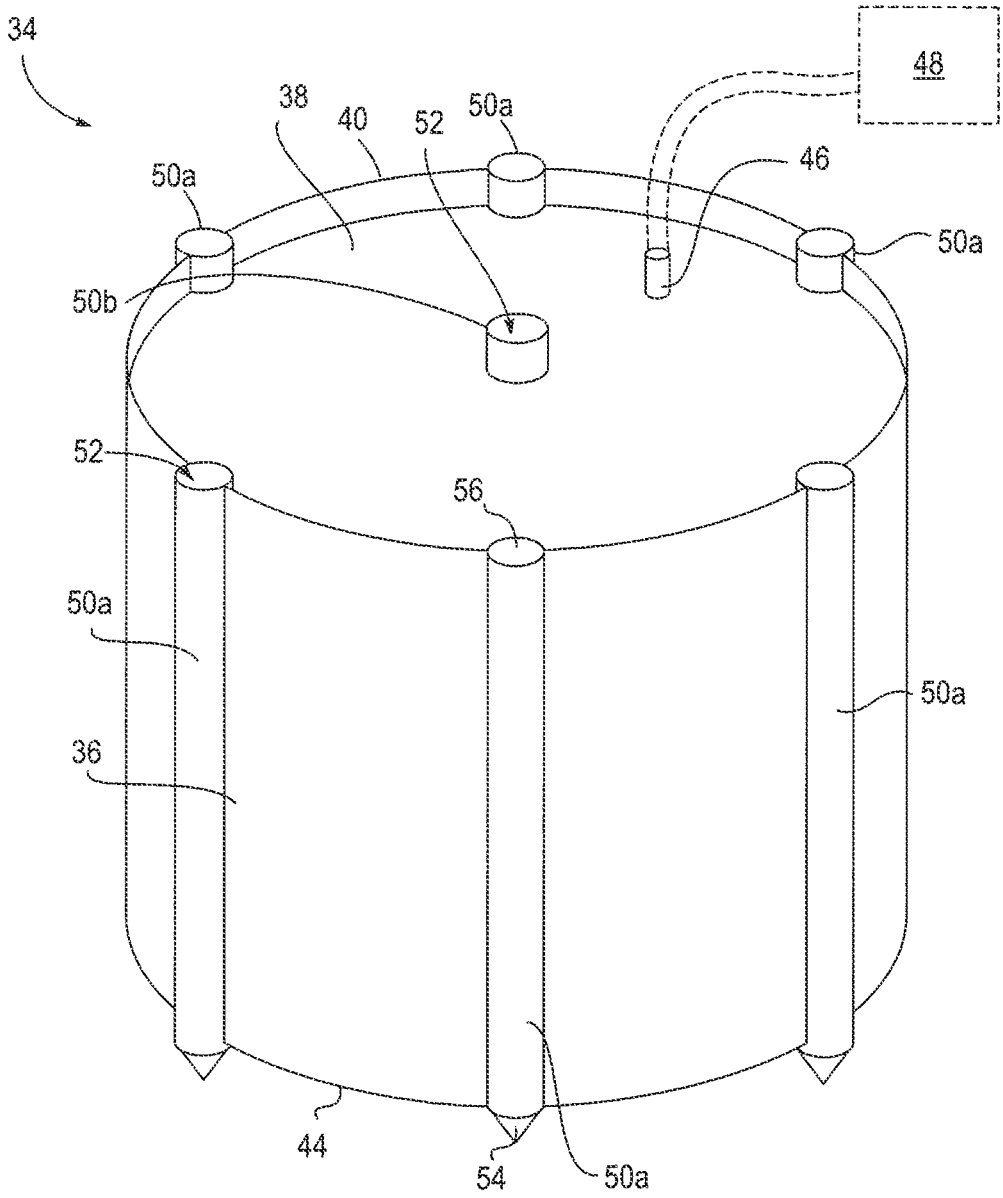
Figure 4:
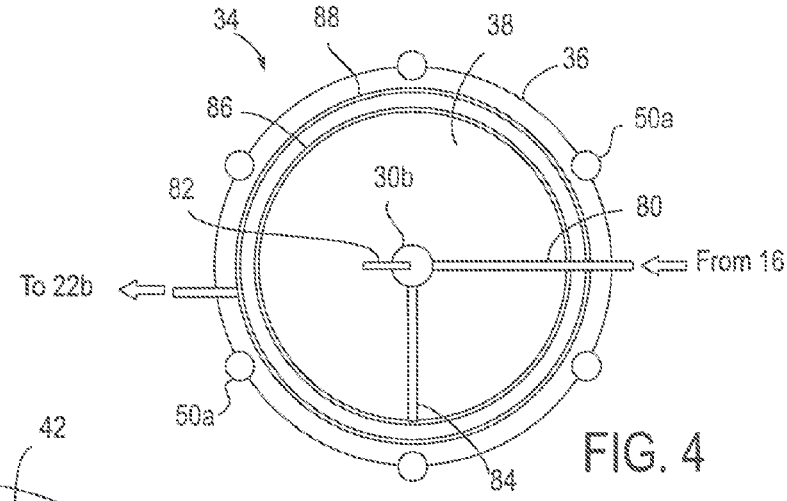
Figure 3:
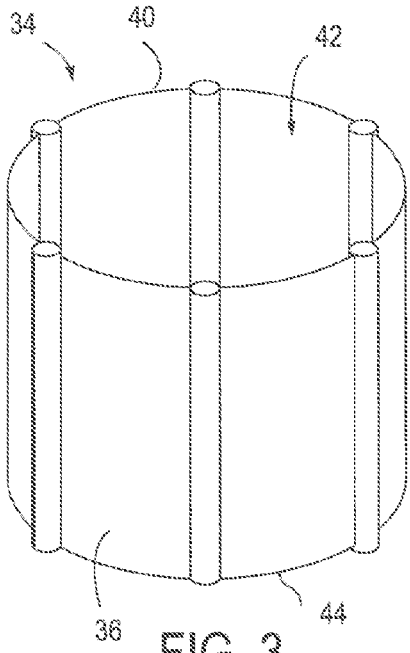
Figure 5:
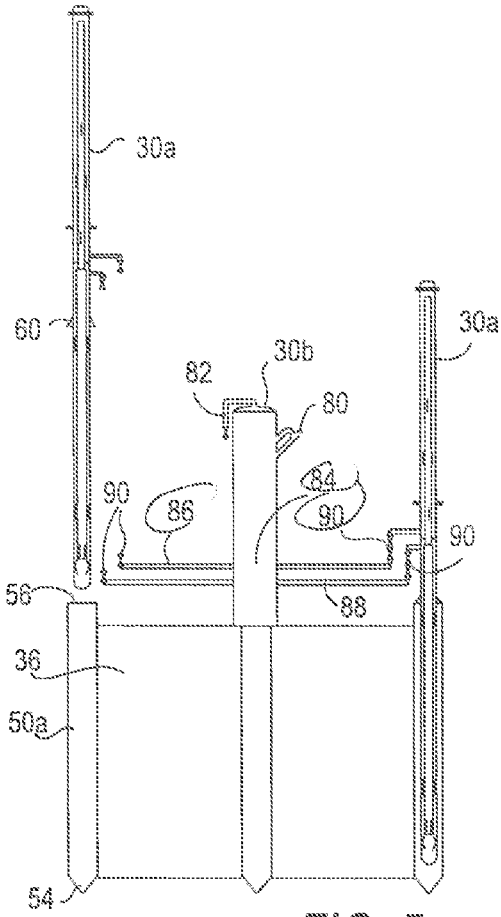
Figure 6:
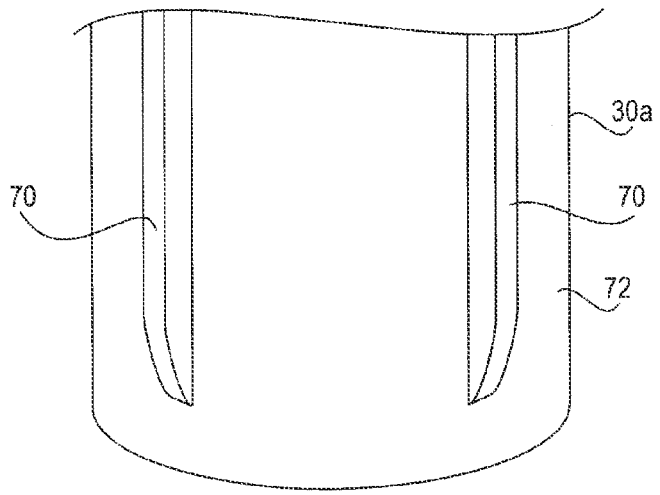
Figure 6:
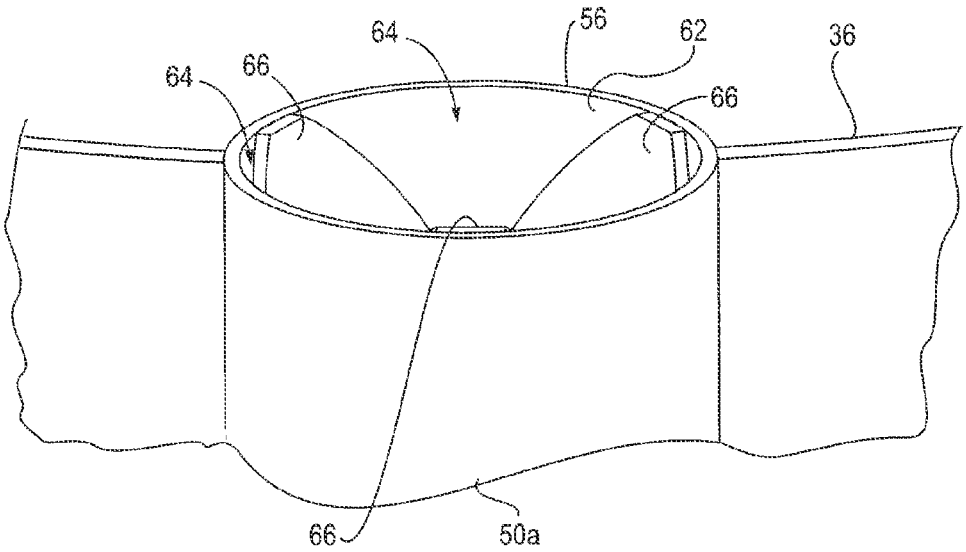
Figure 7:
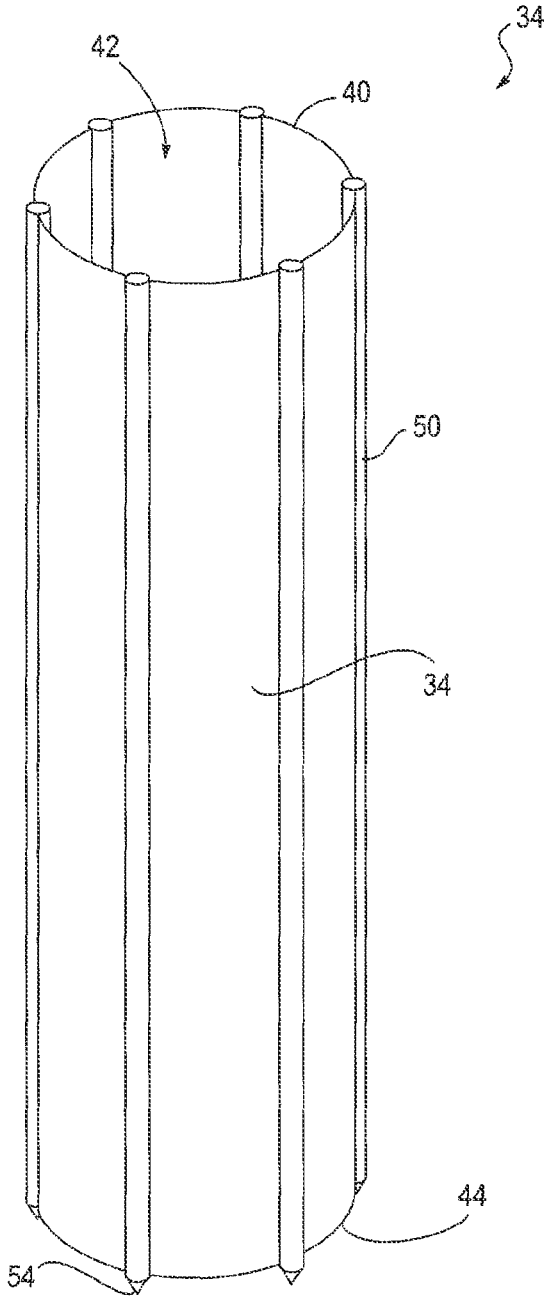
Figure 8:
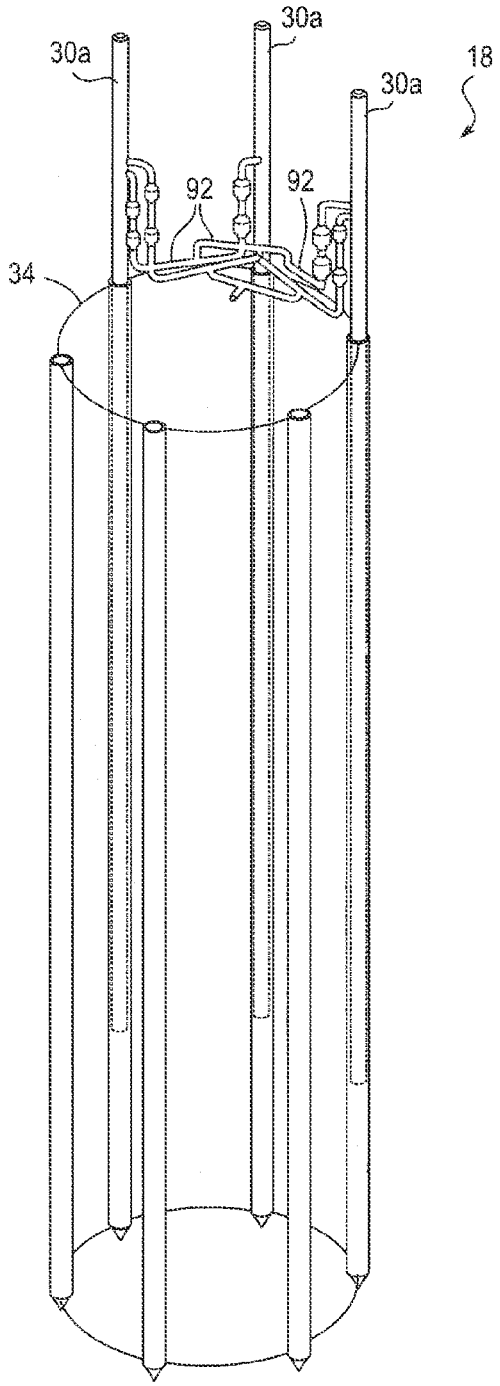
Figure 9:
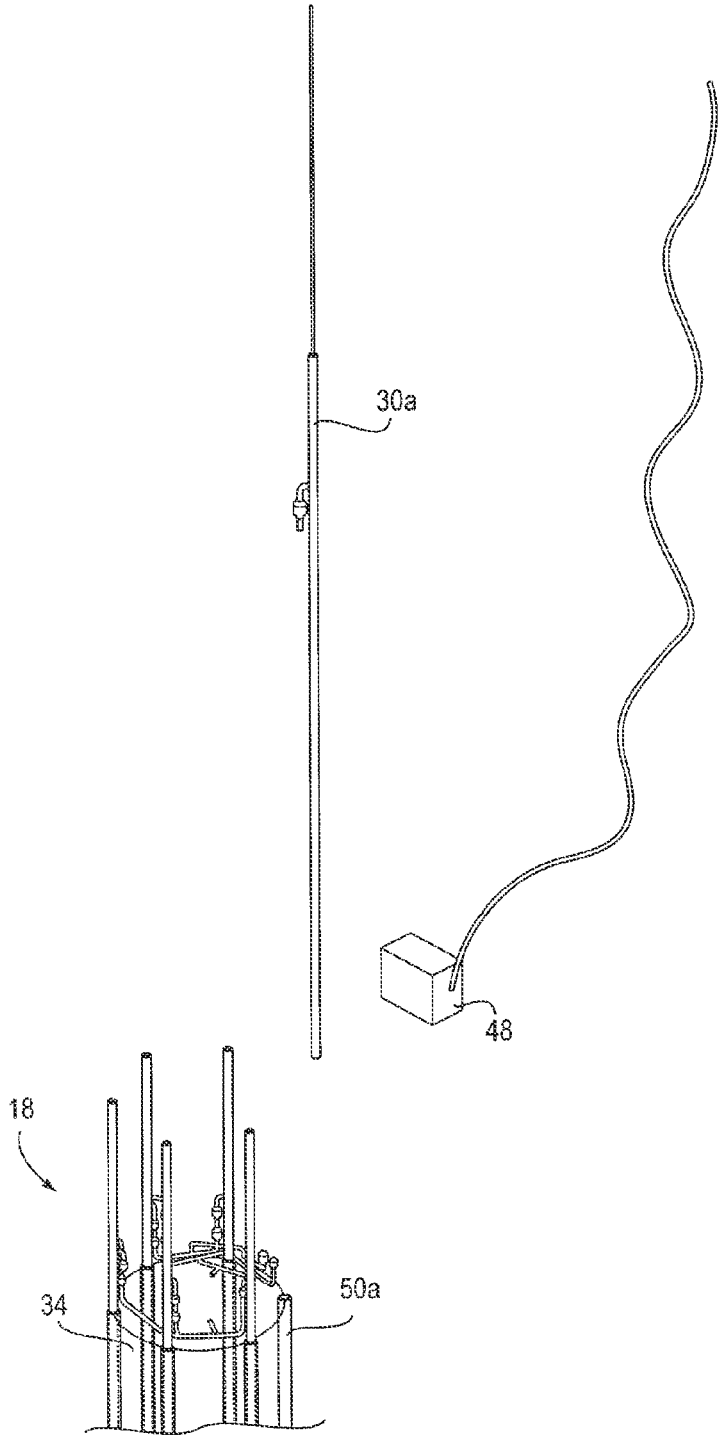
Figure 10:
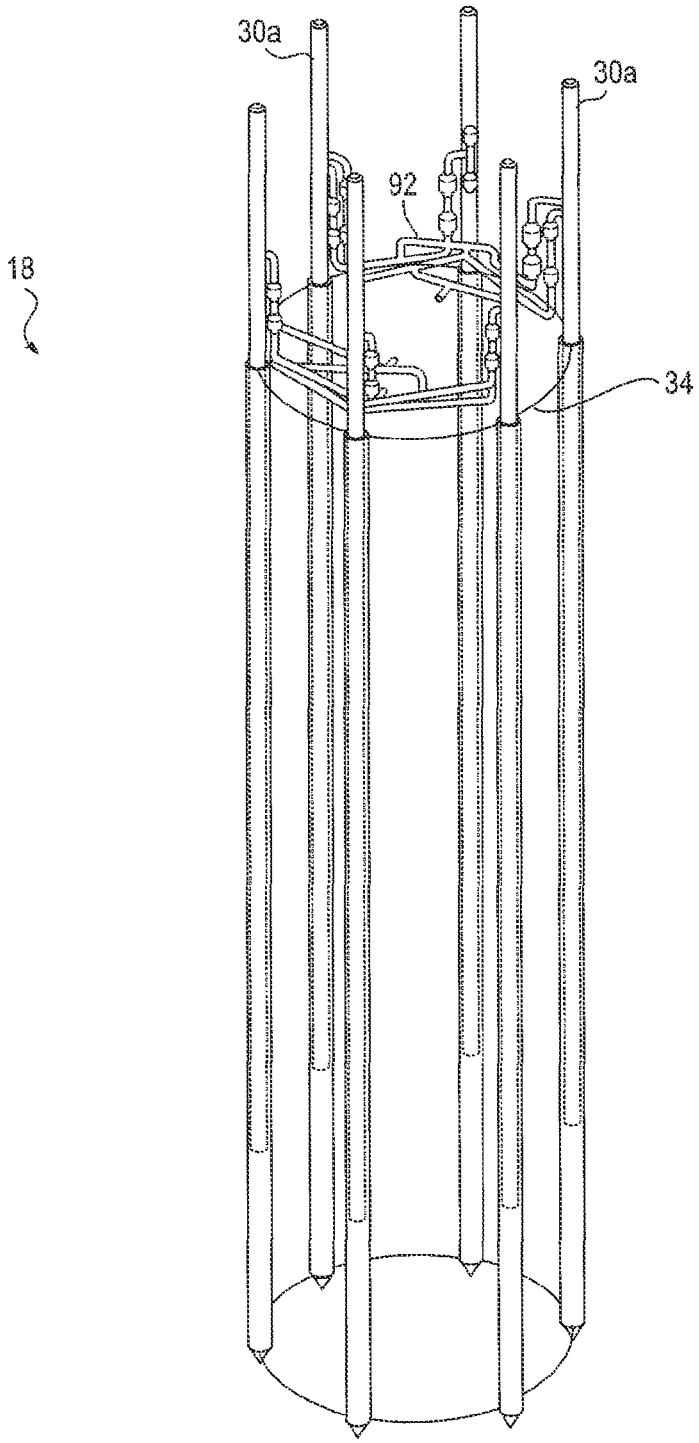
Figure 11:
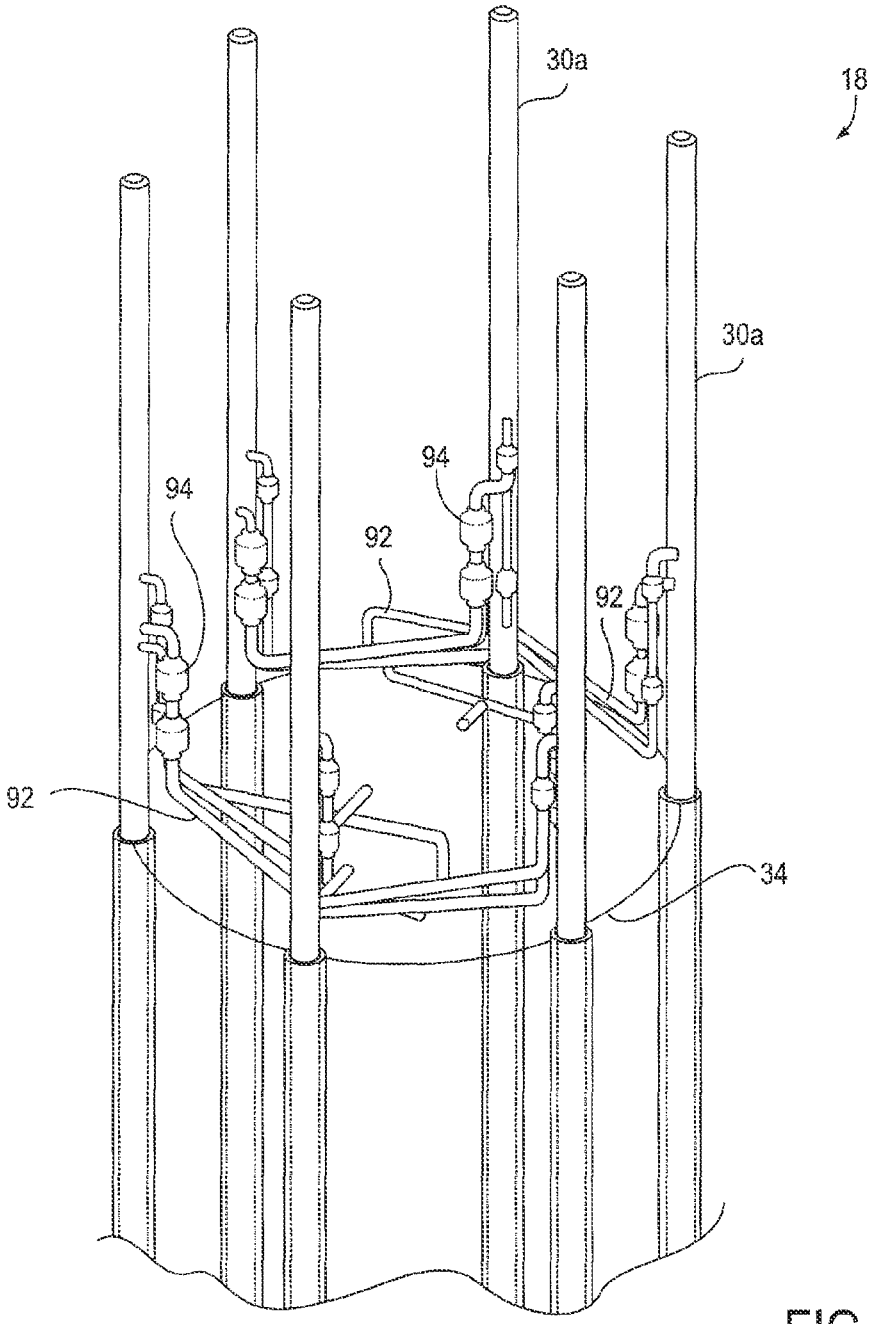

Having thus described the invention in general terms, reference will now be made to the accompanying drawings, which are not necessarily drawn to scale, and wherein:

FIG. 1 is a elevation view schematically illustrating a system for producing hydrocarbons from a subsea reservoir, including an apparatus for securing subsea devices to a seabed according to one embodiment of the present invention;

FIG. 2 is a perspective view of the apparatus of FIG. 1;

FIG. 3 is a perspective view of a portion of the apparatus of FIG. 2;

FIG. 4 is a plan view of the apparatus of FIG. 2;

FIG. 5 is an elevation view of the apparatus of FIG. 2, shown with one subsea device partially installed in the apparatus and a second device in its final position;

FIG. 6 is a partial view of one of the apparatus of FIG. 2 and one of the subsea devices;

FIG. 7 is a line drawing illustrating in perspective an apparatus according to another embodiment of the present invention, with inlet and outlet primary fluid ports for the three in-well type devices shown interconnected, presenting a parallel multiple device embodiment;

FIG. 8 is a line drawing illustrating in perspective the apparatus of FIG. 7, shown with the subsea devices installed or in the process of being installed or withdrawn in the apparatus;

FIG. 9 is a line drawing illustrating in perspective the apparatus of FIG. 8, shown during installation of the subsea devices with a remote operated vehicle (ROV) assisting and/or observing the installation;

FIG. 10 is a line drawing illustrating in perspective the apparatus of FIG. 7, shown with the subsea devices installed in the apparatus, wherein inlet and outlet primary fluid ports are shown interconnected for each of three in-well type devices and for a second set of three in-well type devices, presenting a combined series and parallel multiple device embodiment;

FIG. 11 is a line drawing illustrating the top portion of FIG. 10; and

Figure 12:
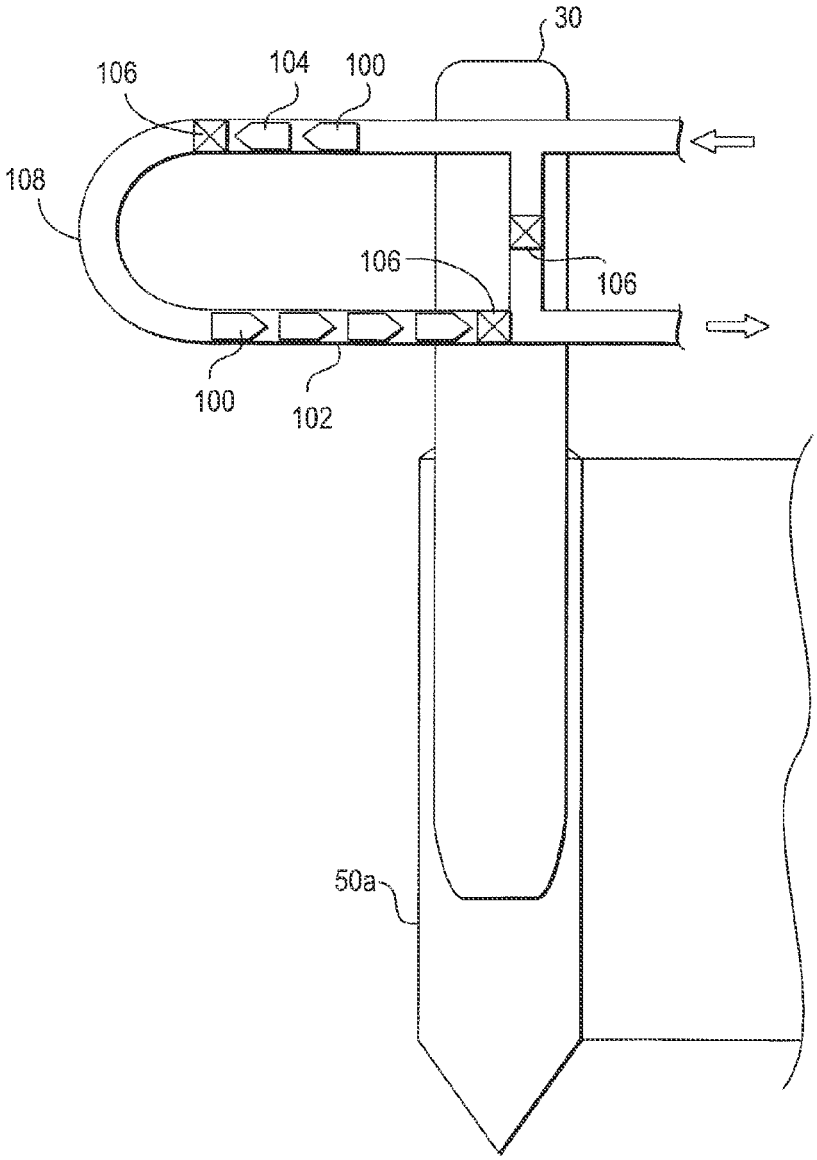

FIG. 12 is a partial view of one of the subsea devices of the apparatus of FIG. 5, where the subsea device is a pig launcher and receiver.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Referring now to the drawings and, in particular, to FIG. 1, there is shown a schematic view of a system 10 for producing hydrocarbons from a subsea reservoir 12 according to one embodiment of the present invention. More particularly, the system 10 can be adapted to produce a flow of produced fluid from a subsea well 14 or other subsea source of fluids, e.g., an incoming pipeline. It is appreciated that the flow of fluid can include a single or multiple phases of materials, such as a mixed flow including one or more of the following: oil, produced water, natural gas, sea water, other fluids, solid particulates, etc. The fluid can be processed, pumped, or otherwise handled subsea before being delivered from the seabed through one or more subsea flowlines, risers, or other pipelines to a surface or land location. For example, as shown in FIG. 1, the produced fluid can received from the well 14 via a subsea flowline 16, processed in an apparatus 18, and then provided to a topside facility 20 at the sea surface 28, e.g., via one or more subsea flowlines 22, a riser 24, and/or an optional intermediate subsea manifold 26 or other equipment. The subsea manifold 26 and/or the topside facility 20 may also receive fluid from other wells or sources. Alternatively, single-phase or multi-phase portions of the fluid (including solids) can be re-injected into the reservoir 12 instead of being delivered to the surface of land location.

As shown in FIG. 1, the system 10 includes the apparatus 18 for securing subsea devices 30*a*, 30*b* (designated collectively by reference numeral 30) to the seabed 32. The apparatus 18 generally includes a mud can housing 34 that can be driven into the seabed 32 and secured to the seabed 32 by evacuating an interior space within the housing 34. In the illustrated embodiment, the housing 34 resembles a conventional "mud can" and has a circumferential side 36 that defines a cylindrical, tubular shape. An upper side 38 near the top of the circumferential side 36 substantially closes the upper end 40 of the circumferential side 36 to define an internal space 42 in the housing 34 that is open at the lower end 44 of the circumferential side 36. Thus, the housing 34 has an open bottom so that the housing 34 is configured to be driven into the seabed 32 by evacuating the internal space 42 of the housing 34 via a tube or other port 46 that communicates with the space 42 through the side 36 or upper side 38. More particularly, the housing 34 can be disposed on the seabed 32, and a remote operated vehicle (ROV) 48 (FIG. 2) or other subsea device can be connected to the port 46 and operated to evacuate water from the internal space 42. Except for the port 46, the internal space 42 can be closed by the cooperation of the circumferential side 36, the upper side 38, and the seabed 32. As the water is removed from the internal space 42, the reduced pressure in the housing 34 can result in the housing 34 being pushed downward into the seabed 32 by the pressure of the seawater outside the housing 34. In this way, the housing 34 can be driven into the seabed 32 and secured thereto. In some cases, the housing 34 can be driven into the seabed 32 by a distance of more than half of the height of the housing 34 so that more than half of the housing 34 is driven into the seabed 32. It is appreciated that the necessary depth to which the housing 34 must be driven for lateral and vertical support and for vertical orientation with the sea bed, or that can be driven as limited by geophysical resistance can depend on the nature of the seabed 32, the configuration of the housing 34, the characteristics of any equipment that is to be secured to the housing 34, the anticipated use of the apparatus 18, and the like.

FIG. 2 illustrates the circumferential side 36 and the upper side 38 of the housing 34. For purposes of illustrative clarity, the housing 34 is shown in FIG. 3 without the upper side 38. The apparatus 18 includes one or more receivers 50 that are connected to the side 36 of the housing 34. As illustrated in FIGS. 2 and 3, the apparatus 18 includes six receivers 50*a* disposed at the circumferential side 36 of the housing 34, and the receivers 50*a* are integrated into the side 36 of the housing 34. A central receiver 50*b* is also provided at the central axis of the housing 34. The receivers 50*a*, 50*b* are designated collectively by reference numeral 50. In other embodiments, the apparatus 18 can include any number of receivers 50, and the side 36 can extend continuously and the receivers 50*a* can be connected to the inside or outside of the circumferential side 36.

Each receiver 50 defines a vertically-oriented cavity 52 that is configured to receive a subsea device 30 in a vertical orientation. Each cavity 52 is typically tall and narrow so that the receiver 50 can receive a subsea device 30 having a similar aspect ratio, e.g., subsea devices such as pumps, sensors, separators, and the like that are designed for deployment in wellbores having relatively small diameters. The subsea devices can also include pig launchers, pig receivers, tubing, hangers, packers, and the like. For example, each receiver 50 can have a generally tubular or cylindrical shape with a diameter of about 4-12 inches and a height of 100-250 feet. As shown in FIGS. 4 and 5, the receivers 50*a* can be located at successive circumferential positions along the side 36 of the housing 34, e.g., about a perimeter of the housing 34, and the housing 34 can be generally symmetrical when viewed from above (FIG. 4).

Each receiver 50 can be closed at its bottom 54 and open at its top 56, and the bottoms of the receivers 50 can be pointed to facilitate the operation of driving the apparatus 18 into the seabed 32. Alternatively, the bottom 54 of each receiver 50 can be open during installation to reduce the necessary force for driving the apparatus 18 into the seabed 32, and the mud from the receivers 50 can be subsequently removed to clear the receiver 50 for service. If each receiver 50 defines an opening at its top 56, as illustrated, the subsea devices 30 can be installed in the apparatus 18 and/or removed from the apparatus 18 while the apparatus 18 is secured to the seabed 32. For example, the housing 34 can be disposed on the seabed 32 and secured to the seabed 32 without the devices 30 in place. Thereafter, the devices 30 can be installed in the apparatus 18, operated, and, if necessary, repaired or otherwise maintained in-place, removed, and/or replaced. Thus, in some cases, the apparatus 18 can include devices 30 that are temporarily installed in the apparatus 18, devices 30 that are permanently installed in the apparatus 18, and/or a combination of devices 30 that are temporarily and permanently installed. In some cases, the bottoms 54 of the receivers 50 can extend below the lower end 44 of the circumferential side 36, such that the weight of the apparatus 18 tends to self drive the receivers 50 into the seabed 32 before the side 36 engages the seabed 32 and the evacuate of the internal space 42 begins. In either case, the receivers 50 can also be "jetted" into the seabed 32 by pumping water into the receivers 50 so that the water flows out the bottom of each receiver 50 and breaks up the soil under the receiver 50, thereby reducing the driving force, either in conjunction with or prior to the other methods for installing the apparatus 18.

As shown in FIG. 5, the subsea devices 30 can be disposed vertically in the receivers 50 so that the devices 30 are secured to the seabed 32 in a vertical orientation when the mud can housing 34 is secured to the seabed 32. Subsea devices intended for vertical positioning within wellbores or other subsea devices can be disposed in their typical configuration in the apparatus 18 so that the devices operate in their typical and/or intended fashion. In the embodiment illustrated in FIG. 5, the subsea devices 30*a* being disposed in the outer receivers 50*a* are subsea pumps. The pumps 30*a* are tall, narrow devices designed to be deployed in a vertical orientation in a subsea wellbore. As illustrated, the pumps 30*a* can be longer than the receivers 50*a* and disposed partially in the receivers 50*a* so that an upper portion of each pump 30*a* extends from the respective receiver 50*a* in which the pump 30*a* is disposed. A stop 60 can be provided on the outer surface of each device 30*a* (e.g., pump or other device) so that the stop 60 rests against the top 56 of the receiver 50 when the device 30*a* is properly disposed in the receiver 50. In this resting position, each device 30 can be disposed in a respective receiver 50 so that the device 30 extends above and below the upper side 38 of the housing 34, as shown in FIG. 5. In some cases, the devices 30 can extend from the housing 34 by a distance that is equal to or greater than the distance by which the devices 30 are inserted into the housing 34. Thus, a housing 34 can be used to secure devices 30 which are longer than the housing 34 and, in some cases, even two or more times as long as the receivers 50.

The receivers 50 and the subsea devices 30 can be configured so that the subsea devices 30 are easily or automatically oriented to a predetermined position in the receivers 50. For example, each receiver 50 can define an inner surface 62 with one or more orientation features thereon. As shown in FIG. 6, the orientation features can include slots 64 that are defined between raised surfaces 66 on the inner surface 62. Each slot 64 is wide at the top 56 of the receiver 50 and narrower at lower locations of the receiver 50. Each device 30 can also define one or more orientation features, such as on or more rails 70 that extend radially outward from the outer surface 72 of the device 30. The receiver 50 can be sized and configured so that the device 30 will fit into the receiver 50 only when the rails 70 are disposed in the slots 64, and the slots 64 can be disposed so that the device 30 is orientated at a predetermined rotational orientation when the device 30 is lowered into the receiver 50 with the rails 70 in the slots 64. If the device 30 is inserted into the receiver 50 at a different rotational orientation, the interaction of the rails 70 with the raised surfaces 66 between the slots 64 will tend to result in a rotation of the device 30 to the predetermined position as the device 30 is lowered to its resting position in the receiver 50. In this way, the orientation features 64, 66 on the inner surface 62 of the receiver 50 can interact with the orientation features 70 of the device 30 so that the device 30 is rotated to a predetermined orientation when installed in the receiver 50. Thus, the devices 30 can be inserted into the receivers 50, e.g., by an ROV, without requiring that the ROV determine or ensure the exact rotational orientation of the devices 30. It is appreciated that the orientation features can vary in different embodiments. For example, in some cases, each side of each raised surface 66 can define a concave or s-shaped profile, and the top of each raiser surface 66 can have a sharp point to reduce the likelihood of the rails 70 getting caught on the top of the surfaces 66. Also, in some cases, a single rail 70 and slot 64 may be used to avoid the possibility of the subsea device 30 being disposed in the receiver 50 in an incorrect orientation.

The orientation features 64, 66 of the receiver 50 can be configured to otherwise ensure the proper positioning of the device 30, e.g., in elevation, horizontally, rotationally, or otherwise. Further, in some cases, each receiver 50 can be configured to otherwise engage the device 30 and/or simulate the conditions of a well, e.g., by providing threads on the receiver 50 to engage threads on the device 30 to secure the device 30 in place, by providing fluid paths or other structures that would typically be provided in a well, or the like. An external collet or a locking bolt device can connect the top of the receiver 50 and a mating surface of the device 30, e.g., "ears" or a ring on the device 30 that stops vertical movement when it reaches the top of the receiver 50 and which could be clamped down or otherwise secured. In this way, each receiver 50 can seal at least a portion of the device 30 from the surrounding seawater, support the device 30 in a particular position and orientation, provide connections to the device 30, and otherwise provide a well-like environment for the device 30.

The subsea device 30*b* in the central receiver 50*b* of FIG. 5 can be a separator, such as a conventional gas-liquid cylindrical cyclone (GLCC) separator, which can receive a flow of the produced fluid through in inclined inlet pipe 80 (including a tangential nozzle), separate gas and liquid phases of the fluid by generating a liquid vortex within the separator, and provide two fluid outputs: a mostly gas-phase flow that is delivered from a first outlet 82 and via a tubular portion 22*a* of the flowline 22 to the subsea manifold 26 and the topside facility 20, and a mostly liquid-phase flow that is delivered from a second outlet 84 and to some or all of the subsea devices 30*a* for processing (e.g., pumping) before being output via a second tubular portion 22*b* of the flowline 22 to the manifold 26 and the topside facility 20. The subsea device 30*b* can also be a solid-liquid hydrocyclone, a device to split a single-phase flow that is then delivered to the multiple devices 30, a hydraulic receiver to support a closed-loop hydraulic power system, or any of a number of devices fluidly positioned on either the incoming or outgoing side of device 30.

The apparatus 18 can also be configured to provide connections between the various devices 30 disposed in the receivers 50. For example, the apparatus 18 can provide an electrical connection between the devices 30 for powering the devices 30 and/or communicating to the devices 30 to control their operation; a fluid connection for transferring the produced fluid between the devices 30 so that the devices 30 can provide parallel or series treatment of the fluid; a hydraulic fluid connection between the devices 30 for providing power for operating the devices 30 and/or communication for controlling their operation; or the like. As shown in FIGS. 4 and 5, the apparatus 18 can include two members 86, 88 that extend circumferentially and define receiver connectors 90, each connector 90 being associated with one of the receivers 50 and configured to mate with a corresponding connector 90 of the subsea device 30 that is installed in the receiver 50. For example, the members 86, 88 can be pipes, the inner pipe 86 being configured to connect to an inlet of each of the devices 30, and the outer pipe 88 being configured to connect to an outlet of each of the devices 30 so that the devices 30 operate in parallel to receive produced fluid from the inner pipe 86, pump or otherwise process the produced fluid, and provide the processed produced fluid (e.g., at a higher pressure) to the outer pipe 88.

In the embodiment illustrated in FIG. 5, the inner pipe 86 can be connected to the second outlet 84 of the GLCC separator 30*b* to receive the mostly liquid-phase flow therefrom, and the outer pipe 88 can be connected by the second tubular portion 22*b* of the flowline 22 to the manifold 26 for delivery to the topside facility 20. The mostly gas-phase flow can be delivered from the GLCC separator 30*b* to the manifold 26 and then delivered to the topside facility 20, either together with the mostly liquid-phase flow or separately therefrom. Thus, the apparatus 18 can include one or more separators and a plurality of subsea pumps and can be configured to receive a flow of the produced fluid, separate different phase components of the fluid, and deliver at least some of the components of the fluid therefrom at an increased pressure.

In addition, or alternative, the members 86, 88 can provide an electrical connection to the devices 30 to provide power for operating the devices 30 and/or for communicating with the devices 30 to control their operation. The nature of the connections between the devices 30 can depend on the intended operation and function of the various devices 30. For example, in some cases, one or more of the devices 30 can be configured to operate as a power transducer, e.g., by receiving electrical power from a remote facility (subsea or topside, such as the facility 20) and generate a hydraulic working fluid that can be delivered to the other subsea devices 30 via hydraulic connections and used to operate the other subsea devices 30, or by receiving hydraulic power from a remote facility (subsea or topside, such as the facility 20) and generate electrical power that can be provided to the other subsea devices 30 via electrical connections and used to operate the other subsea devices 30.

Further, the subsea devices 30 can be configured in any arrangement, possibly with some of the devices 30 performing similar operations (in parallel or series) and other devices 30 performing different operations (in parallel or series). In fact, the apparatus 18 provides a versatile base that can be used to secure any number and type of subsea devices 30 in various configurations depending on the anticipated needs for the particular subsea hydrocarbon reserve.

FIGS. 7-11 illustrate an alternative embodiment in which the subsea devices 30 are connected in a different configuration. The housing 34, shown individually in FIG. 7 and without the upper side 38, can be similar to that illustrated in FIG. 2, though the embodiment of FIG. 7 is shown to have a typical greater height than the embodiment of FIG. 2. The subsea devices 30 are shown in successive stages of installation in FIGS. 8 and 9. More particular, FIG. 8 illustrates the apparatus 18 with three devices 30*a* installed therein and connected by pipes. The connector pipes 92 can provide connections that are similar to those of the circumferential pipes 86, 88 illustrated in FIGS. 4 and 5; however, unlike the circumferential pipes illustrated in FIGS. 4 and 5, each connector pipe 92 in FIGS. 8-11 can extend in a generally straight and/or direct path between one of the devices 30*a* and either a port or another of the devices 30*a*. For example, the output of one device 30 can be delivered by one of the pipes 92 to the input of another device 30 for a series arrangement of flow. Valves or other fluid isolation devices 94 can be provided to control the flow of fluids through the connector pipes 92 and, hence, to and from the devices 30. The connector pipes 92 can be formed of stock components, such as straight pipe sections, elbows, valves, and the like.

As shown in FIG. 9, an ROV 48 can be used in the installation of the apparatus 18, e.g., for driving the housing 34 into the seabed 32, installing the devices 30 into the housing 34, connecting the various devices 30, or the like. FIGS. 10 and 11 illustrate the apparatus 18 with the subsea devices 30*a* installed and connected. In some cases, a separator or other additional device can be used in conjunction with the apparatus 18 of this embodiment, and the separator or other device can be installed on the housing 34 or separately therefrom.

The apparatus 18 can be modified after installation, e.g., according to the needs of the production operation, the performance of the apparatus 18, or the like. For example, additional pumps or other devices can be added, the existing devices 30 can be removed or replaced for maintenance or upgrade, the apparatus 18 can be linked to another similar apparatus 18 for providing increased capacity, or the like.

The connections between the various devices 30 can also be modified after the devices 30 are installed. It is appreciated that valves can be provided in the various connections between the devices 30 and otherwise throughout the apparatus 18 so that each device 30 can be isolated. In this way, one or more of the devices 30 can be removed from operation, e.g., for repair or replacement, even while the other devices 30 continue to operate.

In one embodiment, the apparatus 18 can include a manifold that is configured to fluidly connect the subsea devices 30 to a plurality of ports on the housing 34. The ports, in turn, can be connected by jumper fluid links, which can be removable and reconfigurable. Thus, the devices 30 can be connected in a plurality of configurations by selectively providing the fluid links between the various ports. For example, the connector pipes 92 shown in FIGS. 8-11 can be connected by flexible pipes that function as the fluid links, or some of the connector pipes 92 can be flexible pipes that function as the fluid links.

As noted above, various types of subsea devices 30 can be installed and operated in the apparatus 18. Further, it is appreciated that the devices 30 can be used in a variety of different configurations and/or operations. For example, while the embodiment of FIG. 1 is described above for separating a fluid from a subsea reservoir 12 and pumping the fluid from the seabed 32, the apparatus 18 can alternatively be used for pumping other types of fluids and, in some cases, for pumping fluids into the subsea well 14. More particularly, the subsea devices 30 of the apparatus 18 of FIG. 1 can be pumps that are configured to increase the pressure of an injection fluid, i.e., a fluid injected into the reservoir 12 to aid in the production of fluids from the reservoir 12. For example, the devices 30 can receive the injection fluid from the topside facility 20 and pump the fluid into the well 14. The fluid can be a chemical used for a subsea scale squeeze operation, in which the chemical is pumped into the subsea well 14 to reduce hydrate formations in the well 14 and/or otherwise condition the well or associated equipment.

In some cases, one or more of the subsea devices 30 can be a pig launcher and/or a pig receiver. As shown in FIG. 12, the device 30 can be configured to store a plurality of pigs 100, each pig 100 being configured to pass through the pipes of the system 10, e.g., to clean the pipes by pushing solids through the pipes. As illustrated, the device 30 can store a plurality of the pigs 100 in a supply tube 102, and the pigs 100 can be released or launched from the tube 102 one at a time, so that the device 30 can be used to initiate multiple cleaning operating in downstream flow paths over a long period and then re-loaded only occasionally, e.g., when all of the pigs 100 have been used or when the apparatus 18 is otherwise being maintained. Pigs 100 from upstream flow paths can be received from upstream flow paths to a receiver tube 104. The device 30 can be configured to launch pigs 100 into various flow paths of the system 10 and/or receive pigs 100 from various flow paths of the system 10. Valves 106 can be used to control the flow of the fluid and the pigs 100 through the device 30. A connector 108 can join the receiver tube 104 and the supply tube 102 so that the pigs 100 received by the device 30 can be re-launched. In some cases, the device 30 can operate in parallel to other devices in the apparatus 18, e.g., to receive an incoming pig 100 upstream of a pump in the apparatus 18 and then re-launch the pig 100 downstream of the pump.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus associated with a subsea hydrocarbon production well, the apparatus being configured for positioning into a seabed, the apparatus comprising:

(a) a mud can housing having a circumferential side and an upper side defining a space, the housing having an open bottom;

(b) a port in the mud can housing, the port being adapted for passage of water from the space of the mud can housing to facilitate insertion of the mud can housing into the seabed;

(c) a plurality of receivers connected to the mud can housing, at least one of the plurality of the receivers defining a substantially vertical cavity therein;

(d) a subsea device positioned at least partially within the vertical cavity of one of the receivers, the subsea device being capable of assisting in hydrocarbon production or hydrocarbon transport operations from an associated subsea hydrocarbon well;

(e) wherein the subsea device is selected from the group of devices consisting of: pump, sensor, separator, pig launcher, pig receiver, tubing, hanger, and packer; and (f) wherein the subsea device is configured for facilitating addition or removal of the subsea device from one of the plurality of receivers upon the mud can housing while the mud can housing is secured to the seabed.

2. An apparatus according to claim 1 wherein at least two of the plurality of receivers connected to the mud can housing are configured to receive respective subsea devices.

3. An apparatus according to claim 1 wherein the plurality of receivers are spaced about a perimeter of the circumferential side of the mud can housing and are connected to the circumferential side of the mud can housing.

4. An apparatus according to claim 1 wherein at least one of the plurality of receivers is configured to receive subsea device through an opening defined in the top of the apparatus such that subsea devices can be installed in the apparatus and removed from the apparatus while the housing is secured to the seabed.

5. An apparatus according to claim 1 wherein at least one receiver of the plurality of receivers comprises an orientation feature configured to rotate the subsea device that is lowered into the receiver such that the subsea device is rotatable to a predetermined orientation when installed in the one receiver.

6. An apparatus according to claim 5 wherein the orientation feature of the one receiver comprises a connector configured to mate with a corresponding connector of a subsea device installed in the receiver, the respective connectors being configured to provide electrical conductivity or fluid connection.

7. An apparatus according to claim 6, further comprising a manifold configured to fluidly connect at least one subsea device to the port on the mud can housing.

8. An apparatus according to claim 1 wherein the mud can housing is secured to the seabed and further comprising a plurality of subsea devices, each subsea device disposed in a respective one of the plurality of receivers, and each of said respective subsea devices extending both above and below the upper side of the mud can housing.

9. An apparatus according to claim 8 wherein the plurality of subsea devices comprises at least one separator and a plurality of subsea pumps, the apparatus being configured to:

i) receive a flow of fluid from a well in a subsea hydrocarbon production well;

ii) separate different phase components of the fluid; and iii) deliver at least some of the components of the fluid at an increased pressure.

10. A method for securing subsea devices to a seabed, the method comprising:

(a) positioning a mud can housing on the seabed, the mud can housing having a circumferential side and an upper side that defines a space therein, a plurality of receivers being connected to the mud can housing, at least one of the plurality of the receivers defining a substantially vertical cavity therein, the mud can housing having an open bottom, the mud can housing further providing a port, the port being adapted for passage of seawater out of the mud can housing;

(b) evacuating seawater from the space within the mud can housing through the port;

(c) driving the mud can housing into the seabed to secure the mud can housing to the seabed; and (d) positioning a subsea device at least partially within the cavity of one of the plurality of receivers, the subsea device being capable of assisting in hydrocarbon production or hydrocarbon transport operations from an adjacent subsea hydrocarbon production well, wherein the subsea device is selected from the group of devices consisting of: pump, sensor, separator, pig launcher, pig receiver, tubing, hanger, and packer.

* * * * *